US006134334A

United States Patent [19]

Killion et al.

[11] Patent Number: 6,134,334

[45] **Date of Patent: *Oct. 17, 2000**

[54] DIRECTIONAL MICROPHONE ASSEMBLY

[75] Inventors: Mead C. Killion, Elk Grove Village; Jonathan Stewart, Bloomingdale; Don Wilson, Barrington; Matthew J. Roberts, Palatine; Steve Iseberg, Rolling Meadows; Timothy S. Monroe, Schaumburg, all of Ill.

[73] Assignee: Etymotic Research Inc., Elk Grove Village, Ill.

[ * ] Notice: This patent is subject to a terminal disclaimer.

[21] Appl. No.: 09/479,086

[22] Filed: Jan. 7, 2000

Related U.S. Application Data

[60] Continuation of application No. 09/165,369, Oct. 2, 1998, which is a division of application No. 08/775,139, Dec. 31, 1996, Pat. No. 5,878,147.

[51] Int. Cl.[7] ..... H04R 25/00

[52] U.S. Cl. ..... 381/356; 381/381

[58] Field of Search ..... 381/313, 355, 381/356, 357, 381, 358, 361

[56] References Cited

U.S. PATENT DOCUMENTS 5,524,056 6/1996 Killion et al. ..... 381/68.2
5,613,011 3/1997 Chase et al. ..... 381/169
5,790,679 8/1998 Hawker et al. ..... 381/163
5,848,172 12/1998 Allen et al. ..... 381/356
5,878,147 3/1999 Killion et al. ..... 381/313

*Primary Examiner*—Curtis A. Kuntz
*Assistant Examiner*—P. Dabney
*Attorney, Agent, or Firm*—McAndrews, Held & Malloy, Ltd.

[57] ABSTRACT

A microphone capsule for an in-the-ear hearing aid is disclosed. The capsule can include a top plate having first and second spaced openings defining front and rear sound inlets, and a directional microphone cartridge enclosing a diaphragm. The diaphragm is oriented generally perpendicular to the top plate and divides the directional microphone cartridge housing into a front chamber and a rear chamber. A front sound passage communicates between the front sound inlet and the front chamber, and a rear sound passage communicates between the rear sound inlet and the rear chamber. Front and rear acoustic damping resistors are associated with the front and rear sound passages. The acoustic resistor pair provides a selected time delay, such as about 4 microseconds, between the front and rear sound passages. The use of two acoustic resistors instead of one levels the frequency response, compared to the frequency response provided by a rear acoustic damping resistor alone.

25 Claims, 10 Drawing Sheets

FIG. 3B
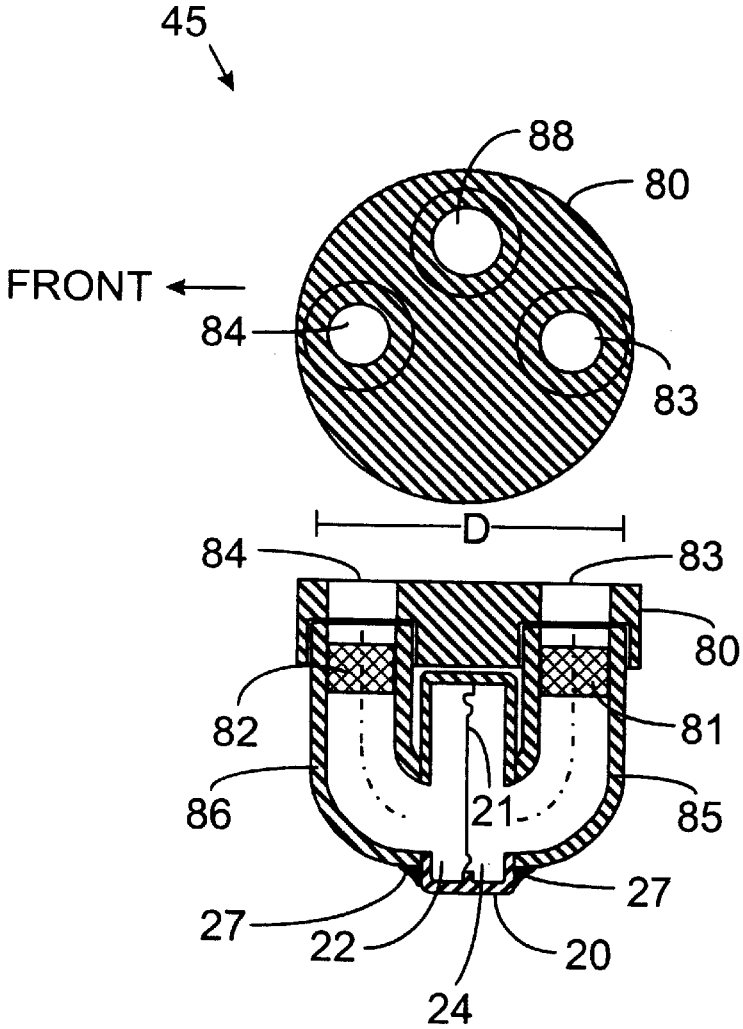
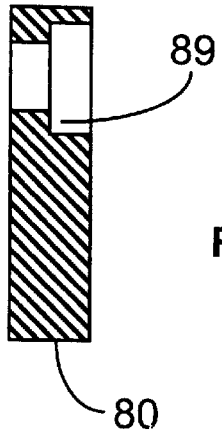
FIG. 3C
FIG. 3A

FIG. 4B
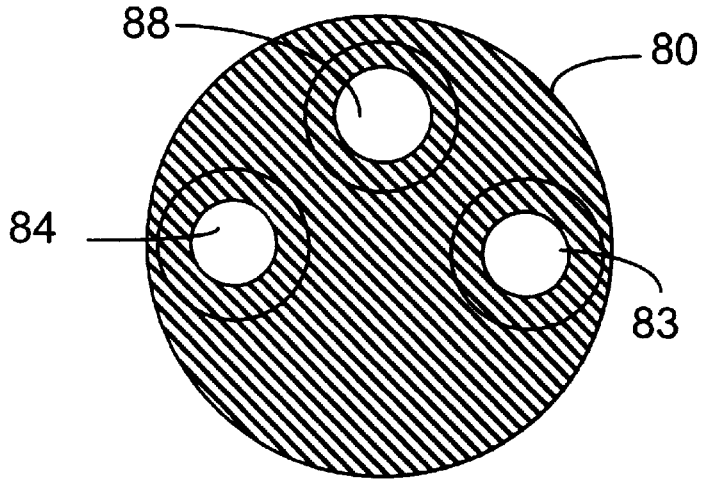
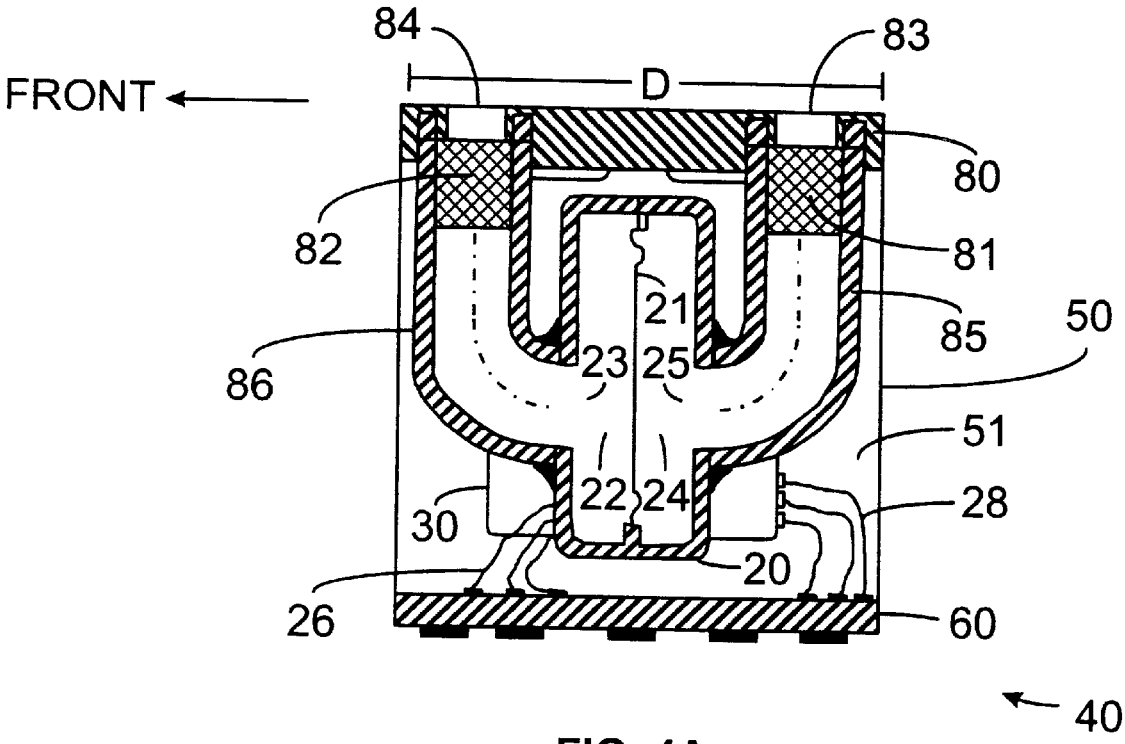
FIG. 4A

FIG. 9B
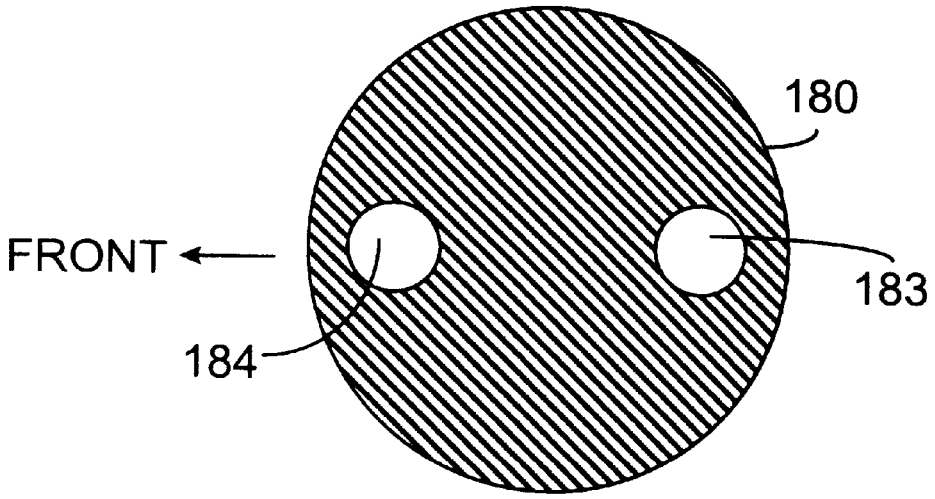
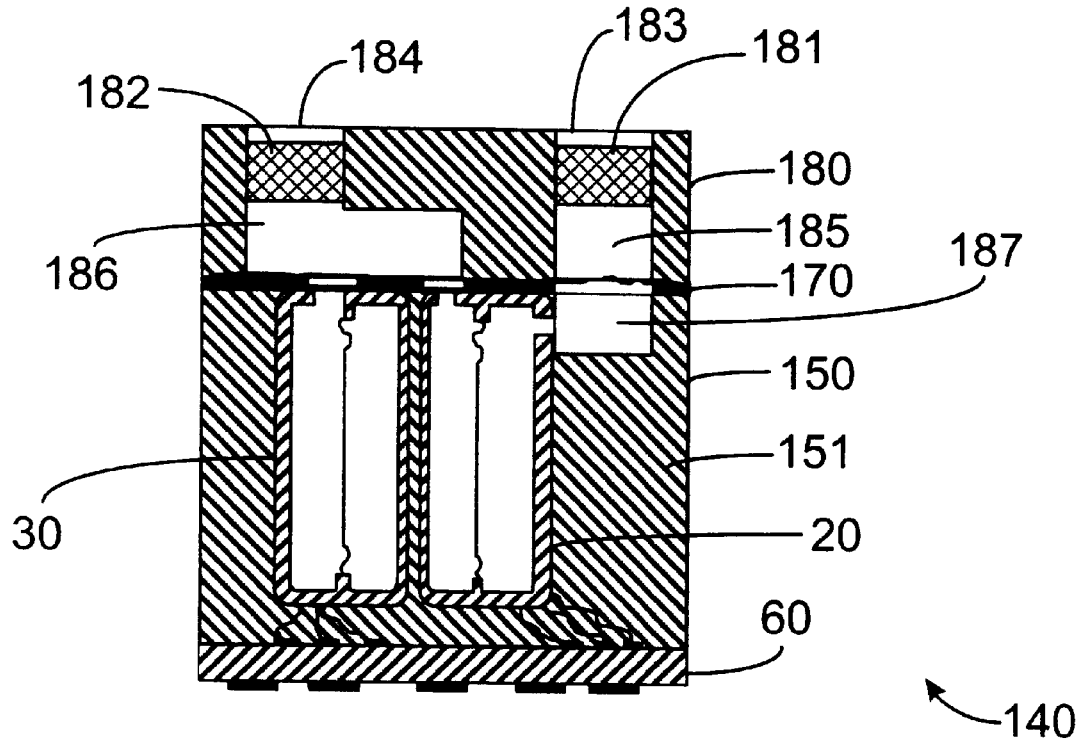
FIG. 9A

DIRECTIONAL MICROPHONE ASSEMBLY

CROSS-REFERENCE TO RELATED APPLICATIONS

This is a continuation of U.S. application Ser. No. 09/165,369, filed Oct. 2, 1998, which is a divisional of U.S. application Ser. No. 08/775,139, filed Dec. 31, 1996, now U.S. Pat. No. 5,878,147.

INCORPORATION BY REFERENCE

The descriptive matter of U.S. application Ser. Nos. 09/165,369 and 08/775,139 and of U.S. Pat. No. 5,878,147 is hereby incorporated by reference in its entirety.

STATEMENT REGARDING FEDERALLY SPONSORED RESEARCH OR DEVELOPMENT

Not Applicable

BACKGROUND OF THE INVENTION

The application of directional microphones to hearing aids is well known in the patent literature (Wittkowski, U.S. Pat. No. 3,662,124 dated 1972; Knowles and Carlson, U.S. Pat. No. 3,770,911 dated 1973; Killion, U.S. Pat. No. 3,835,263 dated 1974; Ribic, U.S. Pat. No. 5,214,709, and Killion et al. U.S. Pat. No. 5,524,056, 1996) as well as commercial practice (Maico hearing aid model MC033, Qualitone hearing aid model TKSAD, Phonak "Audio-Zoom" hearing aid, and others).

Directional microphones are used in hearing aids to make it possible for those with impaired hearing to carry on a normal conversation at social gatherings and in other noisy environments. As hearing loss progresses, individuals require greater and greater signal-to-noise ratios in order to understand speech. Extensive digital signal processing research has resulted in the universal finding that nothing can be done with signal processing alone to improve the intelligibility of a signal in noise, certainly in the common case where the signal is one person talking and the noise is other people talking. There is at present no practical way to communicate to the digital processor that the listener now wishes to turn his attention from one talker to another, thereby reversing the roles of signal and noise sources.

It is important to recognize that substantial advances have been made in the last decade in the hearing aid art to help those with hearing loss hear better in noise. Available research indicates, however, that the advances amounted to eliminating defects in the hearing aid processing, defects such as distortion, limited bandwidth, peaks in the frequency response, and improper automatic gain control or AGC action. Research conducted in the 1970's, before these defects were corrected, indicated that the wearer of hearing aids typically experienced an additional deficit of 5 to 10 dB above the unaided condition in the signal-to-noise ratio ("S/N") required to understand speech. Normal hearing individuals wearing those same hearing aids might also experience a 5 to 10 dB deficit in the S/N required to carry on a conversation, indicating that it was indeed the hearing aids that were at fault. These problems were discussed by applicant in a recent paper "Why some hearing aids don't work well!!!" (Hearing Review, January 1994, pp. 40–42).

Recent data obtained by applicant and his colleagues confirm that hearing impaired individuals need an increased signal-to-noise ratio even when no defects in the hearing aid processing exist. As measured on one popular speech-in-noise test, the SIN test, those with mild loss typically need some 2 to 3 dB greater S/N than those with normal hearing; those with moderate loss typically need 5 to 7 dB greater S/N; those with severe loss typically need 9 to 12 dB greater S/N. These figures were obtained under conditions corresponding to defect-free hearing aids.

As described below, a headworn first-order directional microphone can provide at least a 3 to 4 dB improvement in signal-to-noise ratio compared to the open ear, and substantially more in special cases. This degree of improvement will bring those with mild hearing loss back to normal hearing ability in noise, and substantially reduce the difficulty those with moderate loss experience in noise. In contrast, traditional omnidirectional headworn microphones cause a signal-to-noise deficit of about 1 dB compared to the open ear, a deficit due to the effects of head diffraction and not any particular hearing aid defect.

A little noticed advantage of directional microphones is their ability to reduce whistling caused by feedback (Knowles and Carlson, 1973, U.S. Pat. No. 3,770,911). If the earmold itself is well fitted, so that the vent outlet is the principal source of feedback sound, then the relationship between the vent and the microphone may sometimes be adjusted to reduce the feedback pickup by 10 or 20 dB. Similarly, the higher-performance directional microphones have a relatively low pickup to the side at high frequencies, so the feedback sound caused by faceplate vibration will see a lower microphone sensitivity than sounds coming from the front.

Despite these many advantages, the application of directional microphones has been restricted to only a small fraction of Behind-The-Ear (BTE) hearing aids, and only rarely to the much more popular In-The-Ear (ITE) hearing aids which presently comprise some 80% of all hearing aid sales.

Part of the reason for this low usage was discovered by Madafarri, who measured the diffraction about the ear and head. He found that for the same spacing between the two inlet ports of a simple first-order directional microphone, the ITE location produced only half the microphone sensitivity. Madafarri found that the diffraction of sound around the head and ear caused the effective port spacing to be reduced to about 0.7 times the physical spacing in the ITE location, while it was increased to about 1.4 times the physical spacing in the BTE location. In addition to a 2:1 sensitivity penalty for the same port spacing, the constraints of ITE hearing aid construction typically require a much smaller port spacing, further reducing sensitivity.

Another part of the reason for the low usage of directional microphones in ITE applications is the difficulty of providing the front and rear sound inlets plus a microphone cartridge in the space available. As shown in FIG. 17 of the '056 patent mentioned above, the prior art uses at least one metal inlet tube (often referred to as a nipple) welded to the side of the microphone cartridge and a coupling tube between the microphone cartridge and the faceplate of the hearing aid. The arrangement of FIG. 17 of the '056 patent wherein the microphone cartridge is also parallel with the faceplate of the hearing aide forces a spacing D as shown in that figure which may not be suitable for all ears.

A further problem is that of obtaining good directivity across frequency. Extensive experiments conducted by Madafarri as well as by applicant and his colleagues over the last 25 years have shown that in order to obtain good directivity across the audio frequencies in a head-worn directional microphone it, requires great care and a good understanding of the operation of sound in tubes (as described, for example, by Zuercher, Carlson, and Killion in their paper "Small acoustic tubes," J. Acoust. Soc. Am., V. 83, pp. 1653–1660, 1988).

A still further problem with the application of directional microphones to hearing aids is that of microphone noise. Under normal conditions, the noise of a typical non-directional hearing aid microphone cartridge is relatively unimportant to the overall performance of a hearing aid. Sound field tests show that hearing aid wearers can often detect tones within the range of 0 to 5 dB Hearing Level, i.e., within 5 dB of average young normal listeners and well within the accepted 0 to 20 dB limits of normal hearing. But when the same microphone cartridges are used to form directional microphones, a low-frequency noise problem arises. The subtraction process required in first-order directional microphones results in a frequency response falling at 6 dB/octave toward low frequencies. As a result, at a frequency of 200 Hz, the sensitivity of a directional microphone may be 30 dB below the sensitivity of the same microphone cartridge operated in an omni-directional mode.

When an equalization amplifier is used to correct the directional-microphone frequency response for its low-frequency drop in sensitivity, the amplifier also amplifies the low-frequency noise of the microphone. In a reasonably quiet room, the amplified low-frequency microphone noise may now become objectionable. Moreover, with or without equalization, the masking of the microphone noise will degrade the best aided sound field threshold at 200 Hz to approximately 35 dB HL, approaching the 40 dB HL lower limits for what is considered a moderate hearing impairment.

The equalization amplifier itself also adds to the complication of the hearing aid circuit. Thus, even in the few cases where ITE aids with directional microphones have been available, to applicant's knowledge, their frequency response has never been equalized. For this reason, Killion et al (U.S. Pat. No. 5,524,056) recommend a combination of a conventional omnidirectional microphone and a directional microphone so that the lower-internal-noise omnidirectional microphone may be chosen during quiet periods while the external-noise-rejecting directional microphone may be chosen during noisy periods.

Although directional microphones appear to be the only practical way to solve the problem of hearing in noise for the hearing-impaired individual, they have been seldom used even after nearly three decades of availability. It is the purpose of the present invention to provide an improved and fully practical directional microphone for ITE hearing aids.

Before summarizing the invention, a review of some further background information will be useful. Since the 1930s, the standard measure of performance in directional microphones has been the "directivity index" or DI, the ratio of the on-axis sensitivity of the directional microphone (sound directly in front) to that in a diffuse field (sound coming with equal probability from all directions, sometimes called random incidence sound). The majority of the sound energy at the listener's eardrum in a typical room is reflected, with the direct sound often less than 10% of the energy. In this situation, the direct-path interference from a noise source located at the rear of a listener may be rejected by as much as 30 dB by a good directional microphone, but the sound reflected from the wall in front of the listener will obviously arrive from the front where the directional microphone has (intentionally) good sensitivity. If all of the reflected noise energy were to arrive from the front, the directional microphone could not help.

Fortunately, the reflections for both the desired and undesired sounds tend to be more or less random, so the energy is spread out over many arrival angles. The difference between the "random incidence" or "diffuse field" sensitivity of the microphone and its on-axis sensitivity gives a good estimate of how much help the directional microphone can give in difficult situations. An additional refinement can be made where speech intelligibility is concerned by weighing the directivitiy index at each frequency to the weighing function of the Articulation Index as described, for example, by Killion and Mueller on page 2 of The Hearing Journal, Vol. 43, Number 9, September 1990. Table 1 gives one set of weighing values suitable for estimating the equivalent overall improvement in signal-to-noise ratio as perceived by someone trying to understand speech in noise.

The directivity index (DI) of the two classic, first-order directional microphones, the "cosine" and "cardioid" microphones, is 4.8 dB. In the first case the microphone employs no internal acoustic time delay between the signals at the two inlets, providing a symmetrical figure 8 pattern. The cardioid employs a time delay exactly equal to the time it takes on-axis sound to travel between the two inlets. Compared to the cosine microphone, the cardioid has twice the sensitivity for sound from the front and zero sensitivity for sound from the rear. A further increase in directivity performance can be obtained by reducing the internal time delay. The hypercardioid, with minimum sensitivity for sound at 110 degrees from the front, has a DI of 6 dB. The presence of head diffraction complicates the problem of directional microphone design. For example, the directivity index for an omni BTE or ITE microphone is −1.0 to −2.0 dB at 500 and 1000 Hz.

Recognizing the problem of providing good directional microphone performance in a headworn ITE hearing aid application, applicant's set about to discover improved means and methods of such application. It is readily understood that the same solutions that make an ITE application practical can be easily applied to BTE applications as well.

BRIEF SUMMARY OF THE INVENTION

It is an object of the present invention to provide improved speech intelligibility in noise to the wearer of a small in-the-ear hearing aid.

It is a further object of the present invention to provide the necessary mechanical and electrical components to permit practical and economical directional microphone constructions to be used in head-worn hearing aids.

It is a still further object of the present invention to provide a mechanical arrangement that permits a smaller capsule than heretofore possible.

It is a still further object of the present invention to provide a switchable noise reduction feature for a hearing aid whereby the user may switch to an omni-directional microphone mode for listening in quiet or to music concerts, and then switch to a directional microphone in noisy situations where understanding of conversational speech or other signals would otherwise be difficult or impossible.

It is a still further object of the present invention to provide a self-contained microphone capsule containing the microphone cartridges, acoustic couplings, and electrical equalization necessary to provide essentially the same frequency response for both omni-directional and directional operation.

These and other objects of the invention are obtained in a microphone capsule that employs both an omnidirectional microphone element and a directional microphone element.

The capsule contains novel construction features to stabilize performance and minimize cost, as well as novel acoustic features to improve performance.

Known time-delay resistors normally used in first-order directional microphones will, when selected to provide the extremely small time delay associated with ITE hearing aid applications, give insufficient damping of the resonant peak in the microphone. This problem is solved in accordance with one embodiment of the present invention by adding a second novel acoustic damping resistor to the front inlet of the microphone, and adjusting the combination of resistors to produce the proper difference in time delays between the front acoustic delay and the rear acoustic delay, thereby making it possible to provide the desired directional characteristics as well as a smooth frequency response.

In another embodiment of the present invention, a set of gain-setting resistors is included in the equalization circuit so that the sensitivities of the directional and omnidirectional microphones can be inexpensively matched and so the user will experience no loss of sensitivity for the desired frontal signal when switching from omnidirectional to directional microphones.

In still another embodiment of the present invention, a molded manifold is used to align the parts and conduct sound through precise sound channels to each microphone inlet. This manifold repeatedly provides the acoustic inertance and volume compliance required to obtain good directivity, especially at high frequencies.

In yet another embodiment of the present invention, windscreen means is provided which reduces wind noise but does not appreciably affect the directivity of the module.

BRIEF DESCRIPTION OF THE SEVERAL VIEWS OF THE DRAWINGS

FIG. 3 shows a subassembly of one embodiment of the capsule of the present invention, showing a top plate with sound inlets and sound tubes coupling to the two microphone cartridges.

FIG. 4 shows a cutaway view of one embodiment of a complete capsule in accordance with the present invention, the capsule containing two microphone cartridges mounted in the top plate of FIG. 3 along with appropriate coupling tubes and acoustic resistances and an equalization circuit in order to form directional and omnidirectional microphones having similar frequency response after the directional microphone signal has passed through the equalization circuit.

FIG. 6, plot 42, shows the smooth frequency response obtained when a resistor is added to the front inlet tube of the microphone so that the total resistance is chosen in order to provide the desired response smoothness while the two resistances is chosen in order to provide the required time delay.

FIG. 9 shows still another embodiment of the top plate where molded sound passages in a manifold construction eliminate the need for the coupling tubes and their time-consuming assembly operations.

DETAILED DESCRIPTION OF THE INVENTION DESCRIPTION OF THE PREFERRED EMBODIMENTS

Certain elements of the functions of the present invention, in particular the use of a switch to choose directional or omnidirectional operation with the same frequency response, were described in Applicant's U.S. Pat. No. 3,835,263, dated 1974. The combination of directional and omnidirectional microphones in a hearing aid with an equalization circuit and a switch to provide switching between omnidirectional and directional responses with the same frequency response was described in Applicant's U.S. Pat. No. 5,524,056, 1996. The disclosures of these two patents are incorporated herein by reference.

Figure 1B:
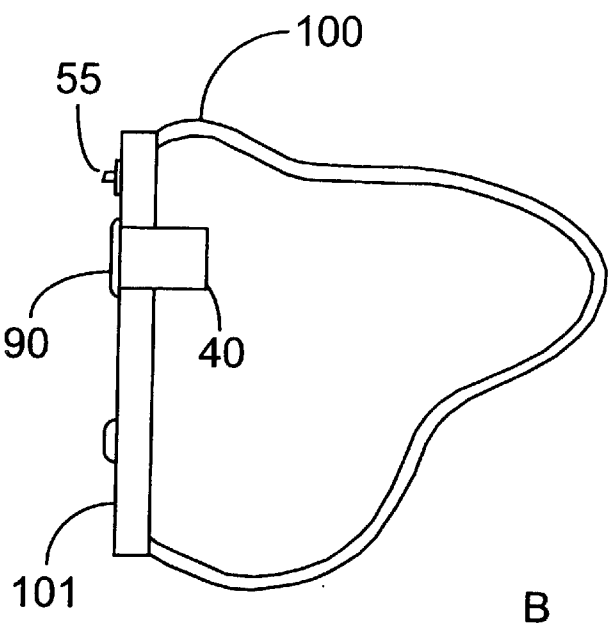
FIG. 1B is a partial cross-sectional view taken along the section line B—B showing the capsule of the present invention.
Figure 1A:
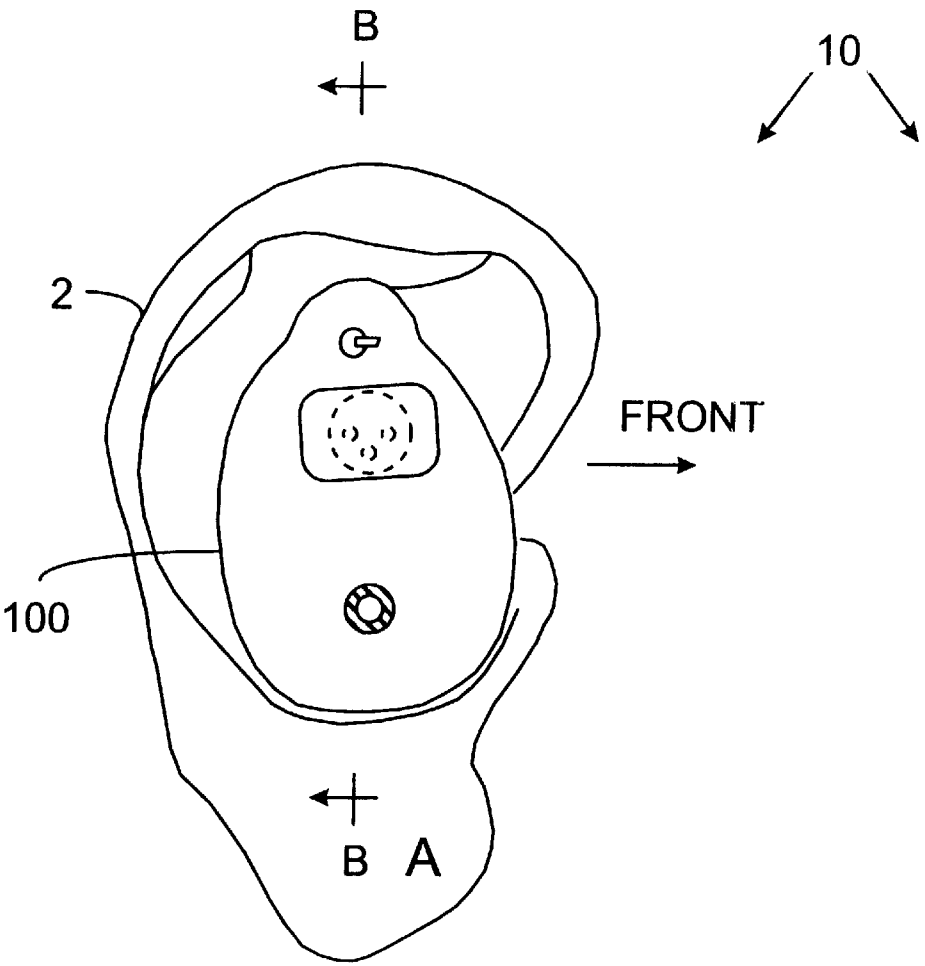
FIG. 1A is side elevation view of one embodiment of a hearing aid mounted in an ear in accordance with the present invention.

A hearing aid apparatus 100 constructed in accordance with one embodiment of the invention is shown generally at 10 of FIG. 1. As illustrated, the hearing aid apparatus 10 utilizes a microphone capsule 40, a switch 55 to select the directional-microphone or omni-directional microphone outputs of capsule 40, and a windscreen 90 to reduce the troublesome effects of wind noise.

Figure 2C:
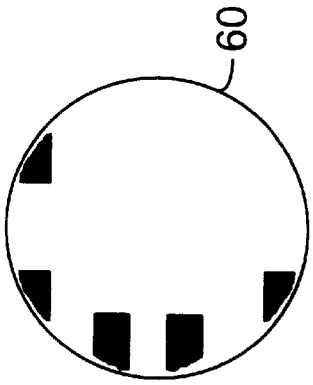
FIGS. 2A, 2B, and 2C show the isolated capsule of the instant invention from the top, side, and bottom views.
Figure 2B:
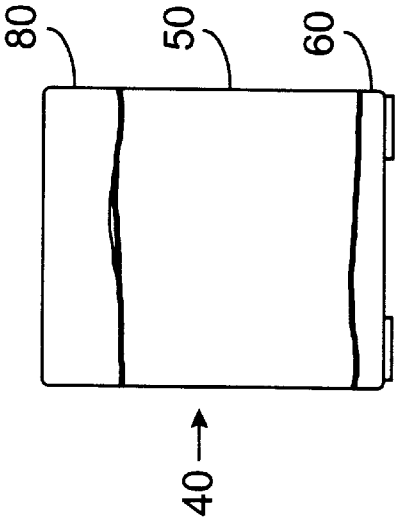
Figure 2A:
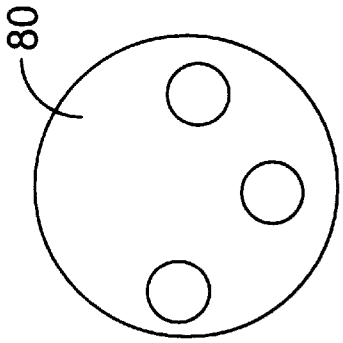

FIG. 2 shows more of the construction of capsule 40, consisting of a top plate 80 (defining an exterior portion of said capsule as worn), a cylinder or housing 50 and an equalization circuit 60.

FIG. 3 shows a subassembly 45 of one embodiment of the capsule 40 of the present invention, showing a top plate 80 with sound tubes 85 and 86 coupling sound inlets 83, 84, to the front chamber 22 and the rear chamber 24 of microphone cartridge 20. Adhesive 27 seals tubes 85 and 86 to microphone cartridge 20. Microphone cartridge 20 is mounted with the plane of the diaphragm 21 generally normal to the top plate 80. This configuration eliminates the need for the prior art metal inlet tube or tubes of the microphone and provides a smaller distance D (measured as shown in FIG. 17 of the '056 patent) than would be possible using prior art constructions. As a result, the diameter of capsule 40 may be maintained at 0.25 inches or less.

Also shown is sound inlet 88, to which omnidirectional microphone cartridge 30 (not shown) is to be connected. Shoulder 89 in inlets 83, 84, and 88 provides a mechanical stop for the tubings 85 and 86 and microphone cartridge 30 (not shown). Tubings 85 and 86 are attached or sealed to top plate 80 and to microphone cartridge 20. Acoustical resistors 81 and 82 provide response smoothing and the time delay required for proper directional operation. Resistors 81 and 82 may for example be like those described by Carlson and Mostardo in U.S. Pat. No. 3,930,560 dated 1976.

FIG. 4 shows a cutaway view of one embodiment of a complete capsule 40 in accordance with the present invention, the capsule containing microphone cartridge 20 mounted as shown in FIG. 3 in order to form a directional microphone, and omnidirectional microphone cartridge 30 mounted into inlet 88 of top plate 80. Each of the microphones 20, 30 is used to convert sound waves into electrical output signals corresponding to the sound waves. Cylinder 50 may be molded in place with compound 51 which may be epoxy, UV cured acrylic, or the like.

Conventional directional microphone construction would utilize only acoustic resistance 81, chosen so that the R-C time constant of resistance 81 and the compliance formed by the sum of the volumes in tube 85 and the rear volume 24 of cartridge 20 would provide the correct time delay. For example, in the present case, the inlets 83 and 84 are mounted approximately 4 mm apart, so the free-space time delay for on-axis sound would be about 12 microseconds. In order to form a cardioid microphone, therefore, an internal time delay of 12 microseconds would be required. In this case, sound from the rear would experience the same time delays reaching rear chamber 24 and front chamber 22 of the microphone, so that the net pressure across diaphragm 21 would be zero and a null in response would occur for 180 degrees sound incidence as is well known to those skilled in the art.

In the case of a head-mounted ITE hearing aid application, however, head diffraction reduces the effective acoustic spacing between the two inlets to approximately 0.7×, or about 8.4 microseconds. If an approximately hypercardioid directional characteristic is desired, the appropriate internal time delay is less than half the external delay, so that the internal time delay required in the present invention would be approximately 4 microseconds. We have found that an acoustic resistance of only 680 Ohms will provide the required time delay. This value is about one-third of the resistance used in conventional hearing aid directional microphone capsules, and leads to special problems as described below.

Microphone cartridges 20 and 30 are wired to equalization circuit 60 with wires 26 and 28 respectively. Circuit 60 provides equalization for the directional microphone response and convenient solder pads to allow the hearing aid manufacturer to connect to both the omnidirectional and equalized directional microphone electrical outputs.

Figure 5:
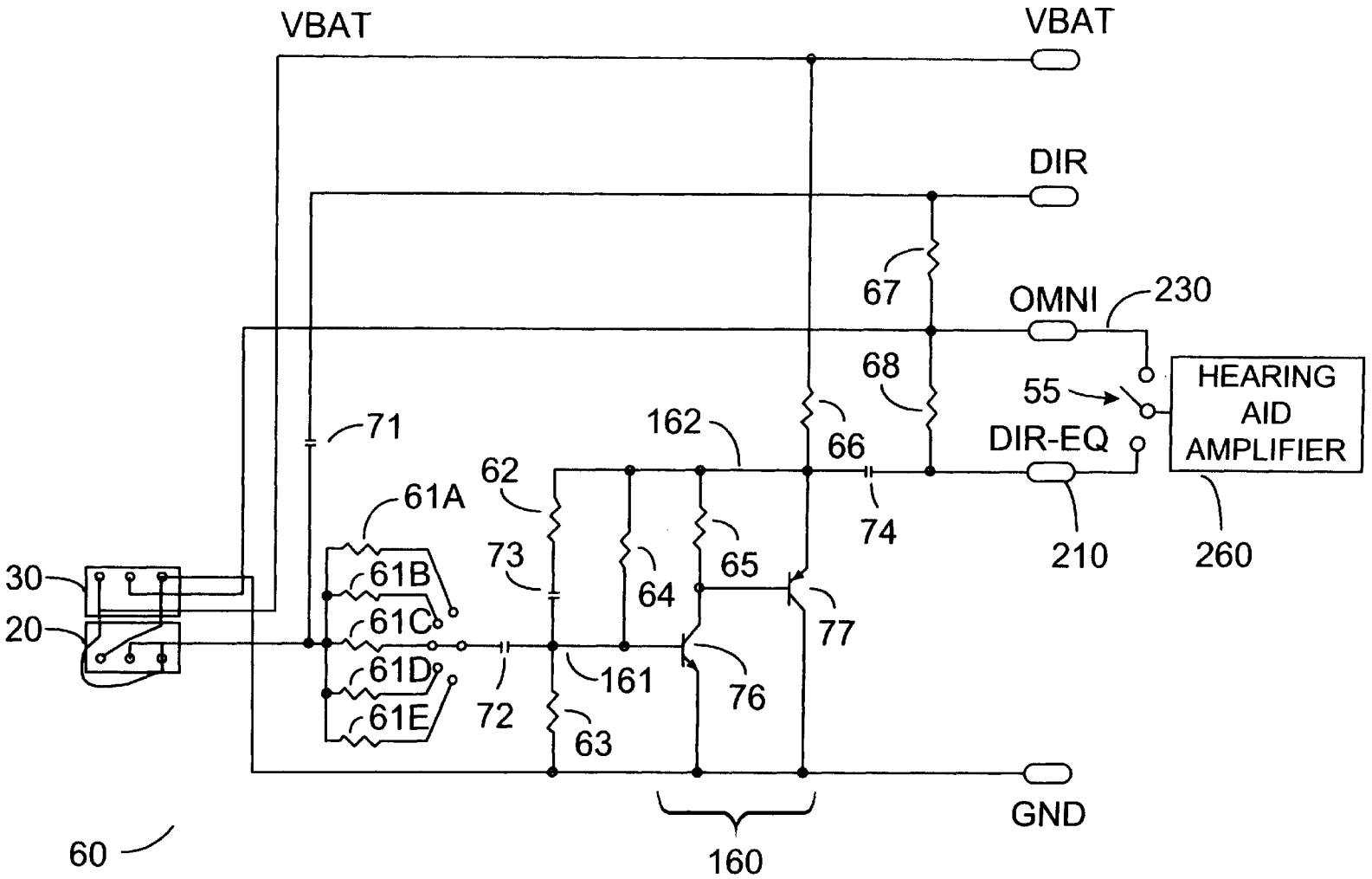
FIG. 5 shows a schematic drawing of one embodiment of the equalization circuit of the present invention.

FIG. 5 shows a schematic drawing of one embodiment of equalization circuit 60. Input resistor 61 can be selected from among several available values 61A through 61E at the time of manufacture, allowing the sensitivity of the equalized directional microphone to be made equal to that of the omnidirectional microphone. Transistors 76 and 77 form a high gain inverting amplifier 160, so that the feedback path consisting of resistor 64 and resistor 62 and capacitor 73 can be chosen to provide compensation for the lower gain and the low frequency rolloff of the directional microphone.

Suitable values for the components in equalization circuit 60 are:

| | |
|---|---|
| 61A | 47kohm |
| 61B | 39kohm |
| 61C | 33kohm |
| 61D | 27kohm |
| 61E | 22kohm |
| 62 | 18kohm |
| 63 | 1Megohm |
| 64 | 470kohm |
| 65 | 220kohm |
| 66 | 22kohm |
| 67 | 1Megohm |
| 68 | 1Megohm |
| 71 | 0.047 $\mu$F |
| 72 | 0.1 $\mu$F |
| 73 | 1000 pF |
| 74 | 0.047 $\mu$F |
| 76 | 2N3904 |
| 77 | 2N3906 |

Circuit 60 has power supply solder pads VBAT, ground pad GND, omnidirectional microphone signal output pad OMNI, directional microphone signal output pad DIR, and equalized directional microphone output pad DIR-EQ.

Figure 6:
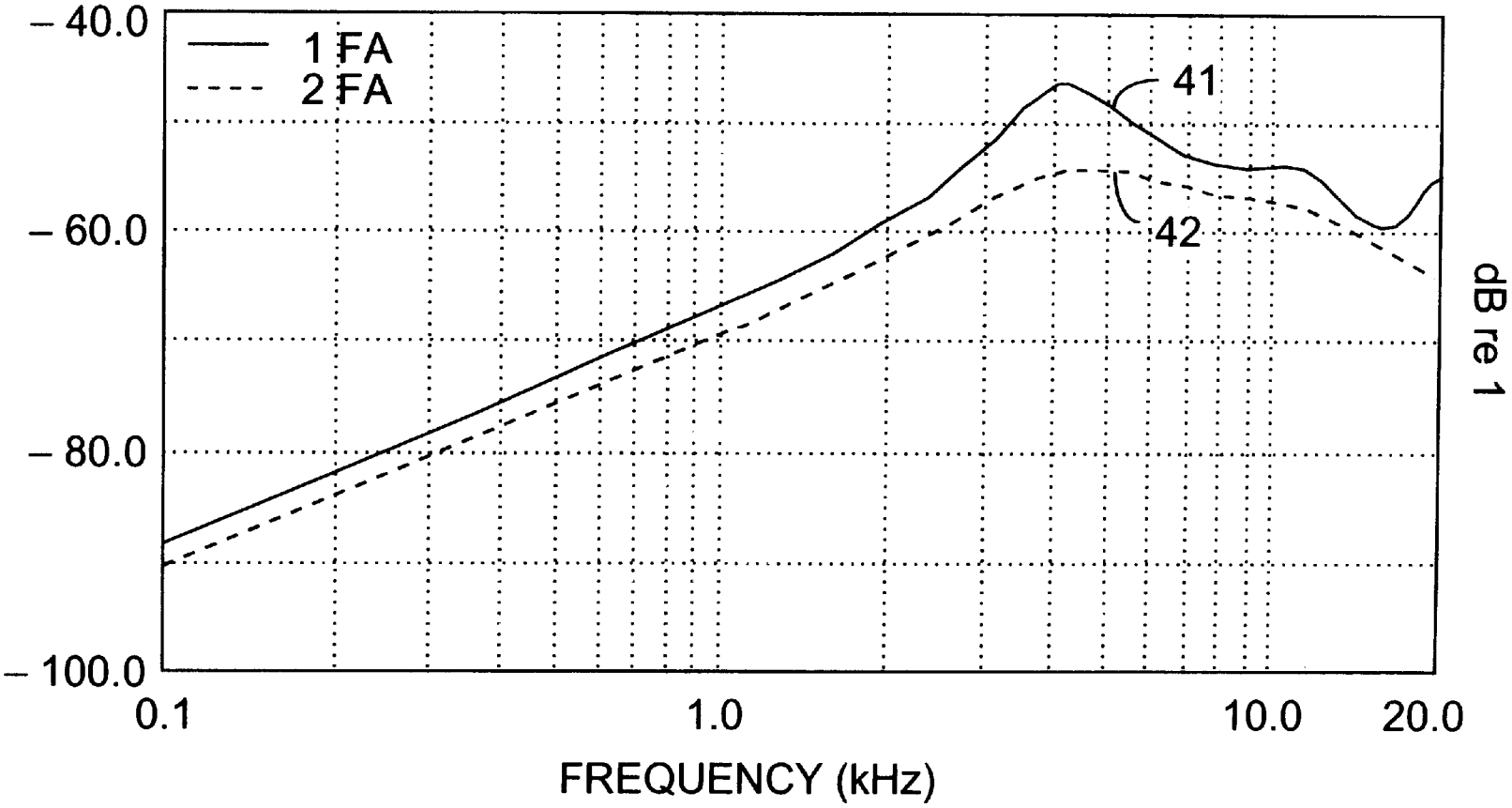
FIG. 6, plot 41, shows the prominent peak in the frequency response of the directional microphone of the present invention when a single acoustic resistance is placed in the rear inlet tube of the microphone to provide the time delay of approximately 4 microseconds required to obtain good directivity in accordance with the present invention when the capsule is mounted on the head in an ITE hearing aid.

FIG. 6 shows an undesirable peak in the directional-microphone frequency-response curve 41 at approximately 4 kHz. This results when a single 680 Ohm acoustic resistance is chosen for resistor 81 in the rear inlet tube 85 of the microphone 20 of FIG. 3. This value provides a time delay of approximately 4 microseconds as required to obtain good directivity in accordance with the present invention when the capsule 40 is mounted on the head in an ITE hearing aid, but produces an undesirable peak. Curve 42 of FIG. 6 shows the frequency response obtained when a total resistance of 2500 Ohms is chosen instead for the combination of resistors 81 and 82 to provide the desired response smoothness. The values of resistors 81 and 82 are then chosen to provide the required time delay of approximately 4 microseconds. We have found that a value of 1500 Ohms for resistor 82 and 1000 Ohms for resistor 81 provides a desired combination of response smoothness and time delay when a Knowles Electronics TM-series microphone cartridge is used for microphone 20, as shown in curve 42 of FIG. 6 and the polar plots of FIG. 8.

Figure 7:
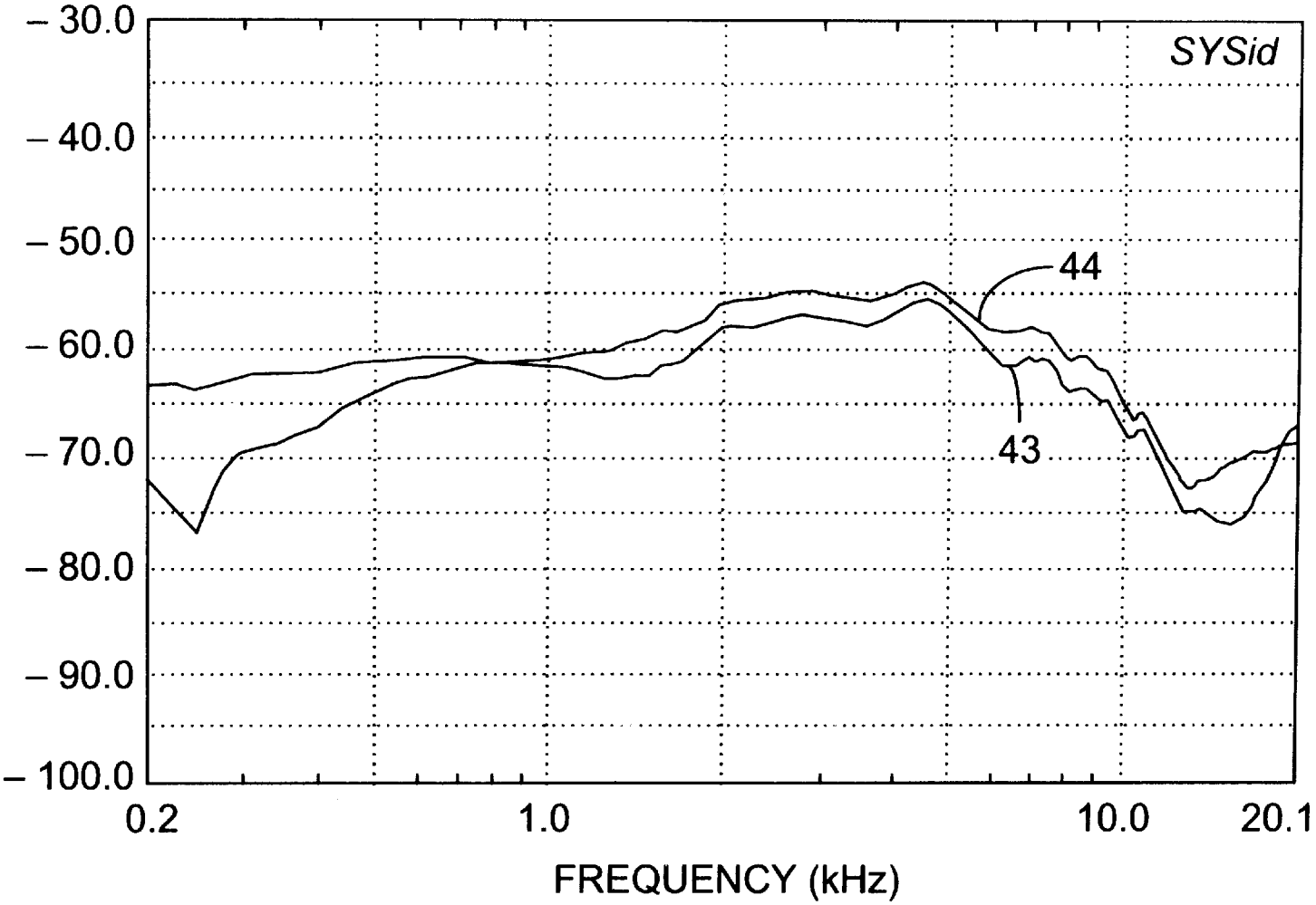
FIG. 7 shows the on-axis frequency response of the omnidirectional microphone and the directional microphone after equalization with the circuit of FIG. 5. Both curves were obtained with the capsule of the present invention mounted in an ITE hearing aid as shown in FIG. 1 placed in the ear of a KEMAR manikin.

FIG. 7 shows the on-axis frequency response 43 of the omnidirectional microphone 30 and on-axis frequency response 44 of the directional microphone 20 after equalization with the circuit of FIG. 5. Both curves were obtained in an anechoic chamber with the capsule 40 of the present invention mounted in an ITE hearing aid placed in the ear of a KEMAR manikin.

Figure 8:
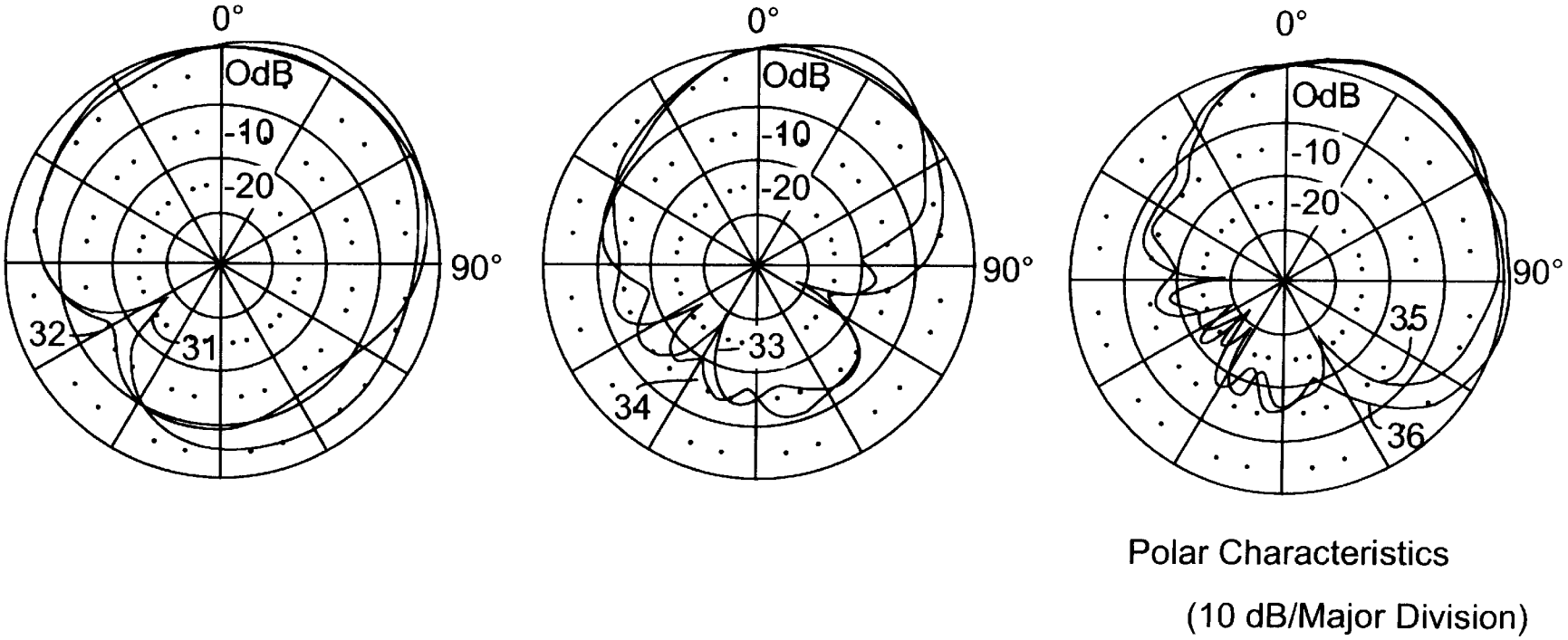
FIG. 8 shows polar plots of the directional microphone of the present invention at frequencies of 0.5, 1, 2, 4, 6 and 8 kHz, measured as in FIG. 7.

FIG. 8 shows polar plots of the directional microphone of the present invention. Table 1 below gives the measurement frequency and the corresponding polar response curve number, Directivity Index, and Articulation Index weighing number.

TABLE 1

| Frequency | Curve # | Index | Directivity AI weighing |
|---|---|---|---|
| 0.5 kHz | 31 | 3.5 dB | 0.20 |
| 1 kHz | 32 | 3.1 dB | 0.23 |
| 2 kHz | 33 | 6.3 dB | 0.33 |
| 4 kHz | 34 | 6.0 dB | 0.18 |
| 6 kHz | 35 | 3.7 dB | 0.06 |
| 8 kHz | 36 | 2.4 dB | 0.0 |

The Directivity Index values give an Articulation-Index-weighted average Directivity Index of 4.7 dB. To the applicant's knowledge, this is the highest figure of merit yet achieved in a headworn hearing aid microphone.

FIG. 9 shows still another embodiment of the capsule of the present invention. Capsule 140 includes top plate 180 that contains molded sound passages 185 and 186 in a manifold type construction, eliminating the need for coupling tubes 85 and 86 of FIG. 4 and their time-consuming assembly operations. Gasket 170 may be cut from a thin foam with adhesive on both sides to provide ready seal for microphone cartridges 20 and 30 as well as top plate 180. Cylinder 150 may be molded in place around the microphone cartridges, leaving opening 187 to cooperate with passage 185 of top plate 180. Circuit 60 provides equalization and solder pads as described above with respect to FIG. 4.

By mounting microphone cartridges 20 and 30 belly to belly in Capsule 140, a single inlet 184 provides sound access to both microphone cartridges 20 and 30, so that resistor 182 provides damping for both cartridges. In this application, the presence of the second cartridge approximately doubles the acoustic load, so to a first approximation only one half the value for acoustic resistor 182 is required. As before, the values of resistors 182 and 181 are chosen to provide both response smoothness and the correct time delay for proper directional operation.

Alternately, plate 180 can be molded with three inlets as is done with plate 80 of FIG. 3. In this case, the front sound passage 186 and rear sound passage 185 plus 187 can be chosen to duplicate the acoustic properties of tubes 85 and 86 of FIG. 3, so that similar acoustic resistors may be used to provide the desired response and polar plots.

Figure 10:
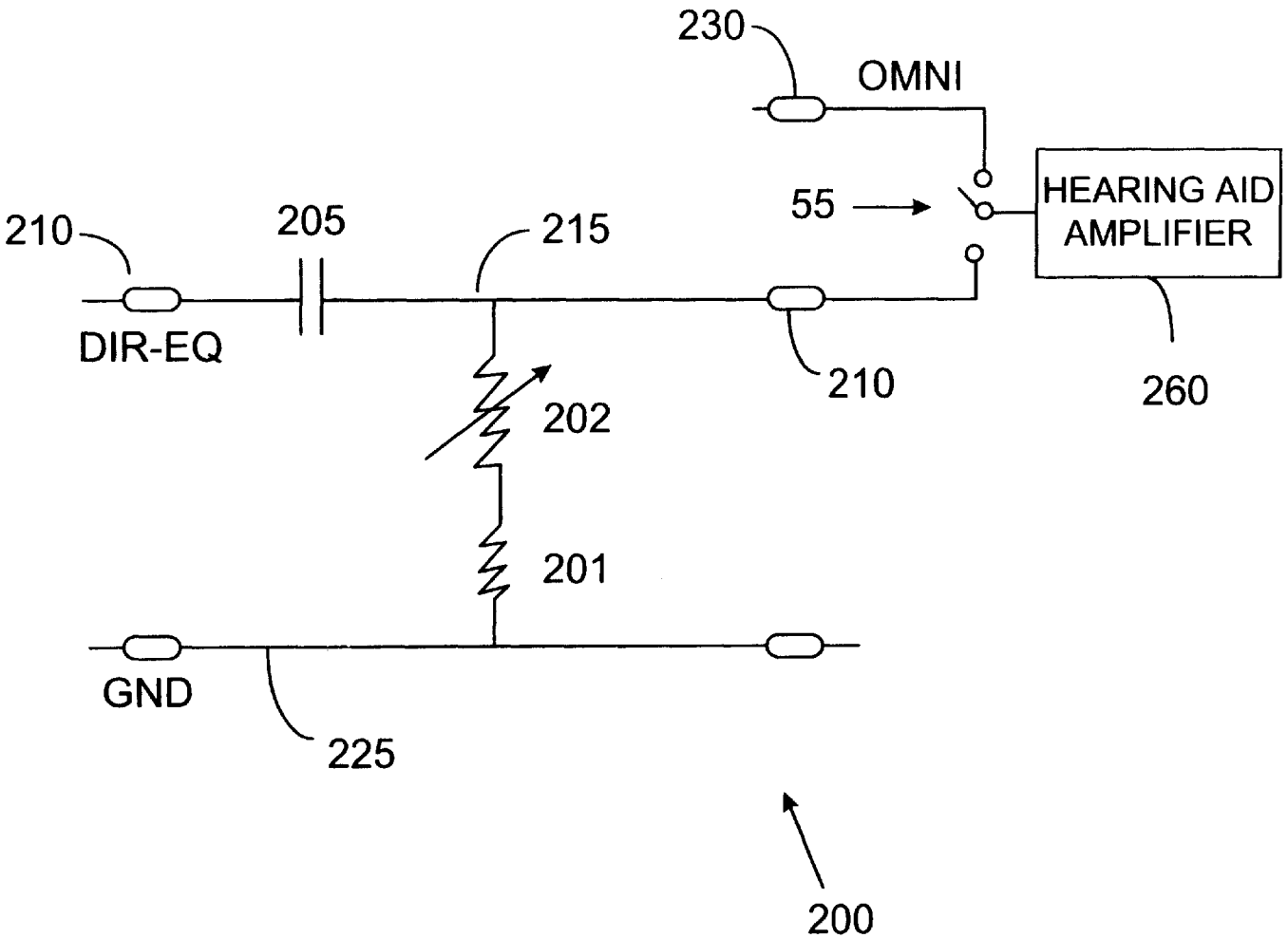
FIG. 10 shows a schematic of a simple low-frequency adjustment for the directional microphone response for those cases where some low-frequency attenuation is desired in high-level noise.

FIG. 10 shows a schematic of a simple low-frequency adjustment circuit 200, where a trimpot adjustment of the directional-microphone low-frequency response can be obtained by adding a capacitor 205 between the DIR-EQ pad 210 of circuit 60 and variable trimpot resistor 202 and fixed resistor 201 connected in series between capacitor 205 and ground 225. The output 210 of circuit 200 is connected to switch 55, as is the output 230 of the mnidirectional microphone. By adjusting resistor 202, the low-frequency rolloff introduced by circuit 200 can be varied between approximately 200 and 2000 Hz. Switch 55 permits the user to select omnidirectional or directional operation. Although the same frequency response in both cases is often desirable, rolling off the lows when switching to directional mode can provide a more dramatic comparison between switch positions with little or no loss in intelligibility in most cases, according to dozens of research studies over the last decade. In some cases, some low-frequency attenuation for the directional microphone response will be desired in high-level noise. The degree of such attenuation can be selected by the dispenser by adjusting trimpot 202.

Many modifications and variations of the present invention are possible in light of the above teachings. Thus, it is to be understood that, within the scope of the appended claims, the invention may be practiced otherwise than as described hereinabove.

What is claimed is:

1. A directional microphone for an in-the-ear hearing aid, comprising:

A. a directional microphone cartridge comprising a directional microphone cartridge housing and a diaphragm mounted within said directional microphone cartridge housing, said directional microphone cartridge housing having a pair of opposed walls, said diaphragm being oriented generally parallel to said pair of opposed walls and dividing said directional microphone cartridge housing into a front chamber and a rear chamber;

B. a front sound passage communicating with said front chamber, said front sound passage having a front sound inlet; and C. a rear sound passage communicating with said rear chamber, said rear sound passage having a rear sound inlet, said front and rear sound inlets being spaced apart a distance of less than 0.25 inches.

2. The directional microphone of claim 1 wherein the distance is approximately 4 millimeters.

3. The directional microphone of claim 1 wherein said pair of opposed walls has a front opening communicating between said front sound passage and said front chamber and a rear opening communicating between said rear sound passage and said rear chamber.

4. The directional microphone of claim 1 further comprising a capsule housing containing said directional microphone.

5. The directional microphone of claim 1 further comprising a top surface defining an exterior portion of said hearing aid as worn.

6. The directional microphone of claim 5 wherein the top surface has first and second spaced openings defining said front and rear sound inlets for communicating with said front and rear sound passages, respectively.

7. A directional microphone for an in-the-ear hearing aid, comprising:

A. a directional microphone cartridge comprising a directional microphone cartridge housing and a diaphragm mounted within said directional microphone cartridge housing, said diaphragm dividing said directional microphone cartridge housing into a front chamber and a rear chamber, said directional microphone cartridge housing having a front opening and a rear opening;

B. a front sound passage having a front sound inlet, said front sound passage communicating with said front chamber through said front opening in said directional microphone cartridge housing; and C. a rear sound passage having a rear sound inlet, said rear sound passage communicating with said rear chamber though said rear opening in said directional microphone cartridge housing, said front and rear sound inlets being spaced apart a distance of less than 0.25 inches.

8. The directional microphone of claim 7 wherein the distance is approximately 4 millimeters.

9. The directional microphone of claim 7 wherein the directional microphone cartridge housing has a pair of opposed walls, and wherein the front and rear openings are located in the pair of opposed walls.

10. The directional microphone of claim 9 wherein the diaphragm is oriented generally parallel to said pair of opposed walls.

11. The directional microphone of claim 7 further comprising a capsule housing containing said directional microphone.

12. The directional microphone of claim 7 further comprising a top surface defining an exterior portion of said hearing aid as worn.

13. The directional microphone of claim 12 wherein the top surface has first and second spaced openings defining said front and rear sound inlets for communicating with said front and rear sound passages, respectively.

14. An in-the-ear hearing aid comprising:

a hearing aid housing having an outer surface;

a first spaced opening in said outer surface defining a front sound inlet;

a second spaced opening in said outer surface defining a rear sound inlet, said front and rear spaced openings being spaced apart a distance of less than 0.25 inches; and a directional microphone mounted with said hearing aid housing, said directional microphone comprising a directional microphone cartridge, a front sound passage acoustically coupling said front sound inlet and said cartridge, and a rear sound passage acoustically coupling said rear sound inlet and said cartridge.

15. The hearing aid of claim 14 wherein the distance is approximately 4 millimeters.

16. The hearing aid of claim 14 further comprising a diaphragm mounted in said directional microphone cartridge, said diaphragm dividing said directional microphone cartridge housing into a front chamber and a rear chamber, said front and rear chambers communicating with said front and rear sound passages, respectively.

17. The hearing aid of claim 16 wherein the diaphragm is oriented generally perpendicular to said outer surface.

18. The hearing aid of claim 16 wherein the directional microphone cartridge housing has a front opening and a rear opening, and wherein the front sound passage communicates with the front chamber via the front opening, and the rear sound passage communicates with the rear chamber via the rear opening.

19. The hearing aid of claim 14 wherein the directional microphone is housed in a capsule housing.

20. The hearing aid of claim 19 wherein the outer surface of the hearing aid housing comprises a top surface of the capsule housing.

21. A directional microphone for an in-the-ear hearing aid, comprising:

a directional microphone cartridge;

a front sound passage communicating with said cartridge, said front sound passage having a front sound inlet; and a rear sound passage communicating with said cartridge, said rear sound passage having a rear sound inlet, said front and rear sound inlets being spaced apart a distance of less than 0.25 inches.

22. The directional microphone of claim 21 wherein the distance is approximately 4 millimeters.

23. The directional microphone of claim 21 further comprising a capsule housing containing said directional microphone.

24. The directional microphone of claim 21 further comprising a top surface defining an exterior portion of said hearing aid as worn.

25. The directional microphone of claim 21 wherein the top surface has front and rear spaced openings defining said front and rear sound inlets for communicating with said front and rear sound passages, respectively.

* * * * *